United States Patent [19]

VandeDrink et al.

[11] 4,235,345

[45] Nov. 25, 1980

[54] FOLDABLE PACKAGING CASE

[76] Inventors: Kenneth R. VandeDrink, 28 Shady La., Elgin, Ill. 60120; Edward J. Cole, 5125 W. Birchwood, Skokie, Ill. 60076

[21] Appl. No.: 61,375

[22] Filed: Jul. 27, 1979

[51] Int. Cl.[3] ..... B65D 6/22

[52] U.S. Cl. ..... 220/6

[58] Field of Search ..... 220/6.7

[56] References Cited

U.S. PATENT DOCUMENTS

| | | | |
|---|---|---|---|
| 1,433,169 | 10/1922 | Zimmerman | 220/6 |
| 3,223,274 | 12/1965 | Tolnai | 220/7 |
| 3,870,185 | 3/1975 | Sanders | 220/6 |

FOREIGN PATENT DOCUMENTS

| | | | |
|---|---|---|---|
| 2734964 | 2/1979 | Fed. Rep. of Germany | 220/6 |
| 1279245 | 6/1972 | United Kingdom | 220/6 |

*Primary Examiner*—George E. Lowrance

*Attorney, Agent, or Firm*—Lockwood, Dewey, Alex & Cummings

[57] ABSTRACT

Improved foldable packaging cases are provided which are particularly suitable, when in their fully opened condition, for use in transporting a plurality of cartons containing fluid products, particularly liquid dairy products such as milk and flavored drinks. The improved cases include structural features that cooperate to provide a case that is readily folded into a compact unit that is especially suitable for opening up to its fully unfolded condition by automatic case opening means, and which when so opened is structured to provide a rigid enclosure that retains a substantially rectangular shape when in use by avoiding both unintentional inward collapsing and undesirable bowing out of the foldable walls.

13 Claims, 6 Drawing Figures

FOLDABLE PACKAGING CASE

BACKGROUND AND DESCRIPTION OF THE INVENTION

The present invention relates generally to improvements in foldable packaging cases used for transporting a plurality of products as a single unit, and more particularly to certain improvements in the structure of such cases which enhance the ability of the cases to be readily folded, to be unfolded by automated machinery, and to maintain their desired structural configuration and integrity while transporting said plurality of items as a single unit. An important aspect of the invention is the provision of improved hinge assembly means for carrying out the folding or collapsing functions while at the same time providing a snap-together operative interengagement between the individual portions of the device in order to facilitate replacement of damaged portions of the device.

Collapsible crates in general are known, earlier developments in this regard being represented for example by Hunter U.S. Pat. No. 1,180,294, Hartson U.S. Pat. No. 1,972,483, Smith et al U.S. Pat. No. 2,525,838, Frerking U.S. Pat. No. 2,803,084 and Oakey et al U.S. Pat. No. 3,130,850. Devices of the general types illustrated in these patents include assembly means and hinging mechanisms that are comprised of separate parts that are put together in a variety of ways and by a variety of structures, which leads to expensive production costs and which provides surface irregularities and multiple materials interfaces between these assembled parts, thereby presenting serious cleaning problems and requiring maintainance as the assembled parts loosen with respect to each other during use.

Progress in the collapsible container art in general over these earlier developments and structures is illustrated by Sanders et al U.S. Pat. No. 3,796,342 which describes a container for egg cartons that will collapse vertically and that can be made from molded plastic material parts that are permanently assembled together to the degree that they can be disassembled only with considerable effort, this patent also showing relatively fragile plastic webs as hinges. Another example of a more contemporary collapsible crate structure is that shown in Box U.S. Pat. No. 4,044,910 intended for transporting and storing fruits and vegetables, which container has inwardly folding wall members that are of a unitary construction with the hinge portion of the crate, such unitary hinges taking the form of thin plastic webs that connect the crate base to the side walls, each of which folds on top of the crate base and in some instances on top of one another, such structures taking up a floor space the same size as that taken up by the uncollapsed crate.

By the present invention, a foldable packaging case is provided which avoids the complicated construction aspects, the cleaning difficulties and the maintainance requirements of the earlier approaches to collapsible containers, while at the same time providing a device made of molded plastic parts that are structured to be snapped together and snapped apart when necessary to replace damaged portions thereof while also providing a container which, when collapsed, requires a storage floor space less than that required for the unfolded case, that is stackable in a secure manner onto another such collapsed case, and that takes up a volume between about ⅓ and 1/5 of the volume taken up by the opened, unfolded case, all while including hinge means and assembly means that are of durable construction and that provide operative interengagements that facilitate automated opening of the folded cases while providing positive locking of the case in its fully unfolded condition such that its walls will neither prematurely collapse nor buckle outwardly when filled or partially filled with individual containers, such as those used in marketing dairy products, fruit juices and the like.

It is accordingly a general object of this invention to provide an improved foldable packing case.

Another object of the present invention is to provide an improved foldable packing case for transporting and storing a plurality of items such as cartons containing dairy products or the like.

Another object of this invention is to provide an improved foldable packaging case that is constructed of a plurality of members that are operatively interconnected with each other by snap-together means that are molded onto each respective member as a unitary component part.

A further object of the present invention is an improved foldable packing case that, when folded, provides two generally parallel panel members that are structured such that a plurality of the improved foldable packaging cases have aligning mating portions that engage one folded case with another folded case for enhancing the stability of stacks of folded cases one upon another.

Another object of the present invention is to provide an improved foldable packaging device containing no metal inserts while providing hinge means having portions that rotate relative to each other when the packaging case is moved between its open condition and its closed condition.

Another object of this invention is an improved packaging case constructed of but one type of material or materials having similar coefficients of thermal expansion in order to avoid differences in expansion or contraction of individual parts upon storage in cooled environments or upon washing with hot solutions, which differences could lead to disfigurement of or structural damage to the case.

Another object of this invention is an improved foldable packaging case that significantly reduces storage space required when not in use and reduces the amount of space needed to haul the folded containers back to the refilling location to thereby reduce the round trip mileage of a delivery truck by permitting folded cases to be picked up by and stored within the limited free space within the truck trailer while the trailer is on its rounds delivering such cases that are unfolded and full of dairy products or the like.

These and other objects of the present invention will be apparent from the following detailed description taken in conjunction with the accompanying drawings, wherein.

Figure 1:
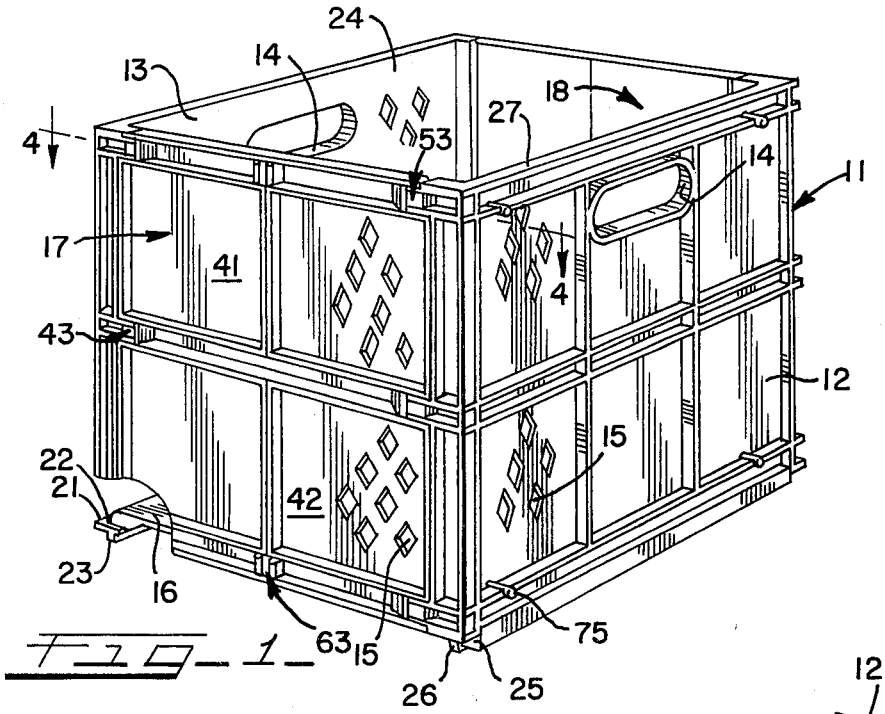
FIG. 1 is a perspective view of the preferred embodiment of the packaging case according to this invention, shown in its fully opened state or condition.
Figure 2:
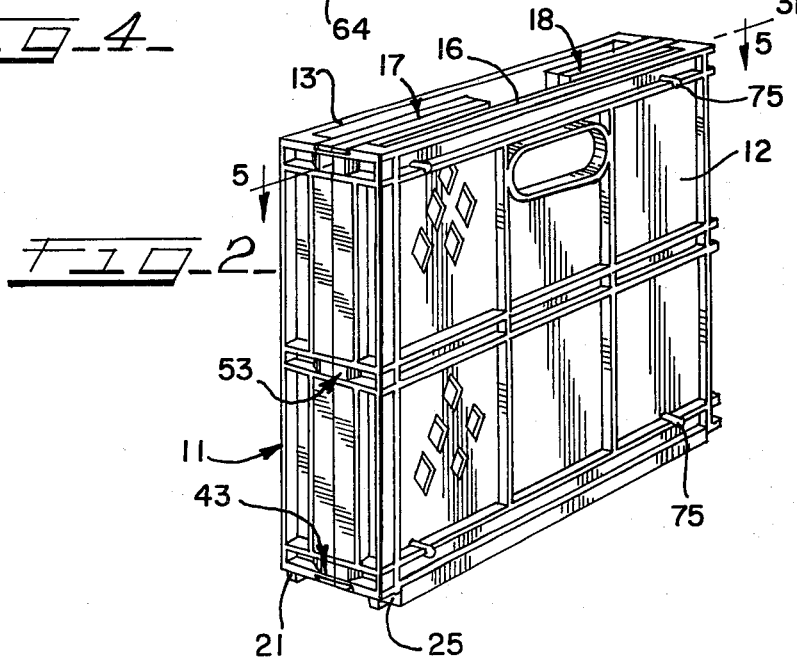
FIG. 2 is a perspective view of the foldable packaging case of FIG. 1, shown standing on end in its folded state or condition.

The preferred foldable packaging case, generally designated at 11 in FIG. 1, includes two end wall panel members 12, 13, which are preferrably of a unitary rigid construction having handles 14 and, if desired, cut-out portions 15 for reducing weight and for facilitating cleaning of the interior of the case 11. Case 11 also includes a fold-up floor member 16 and foldable side members, generally designated at 17 and 18, each of which may also include cutout portions 15. The case 11 is shown in FIG. 2 in its fully folded or collapsed condition, each of the foldable side walls or members 17 and 18 having been folded inwardly onto each other to the extent that they lie one on top of the other with substantially no free space or clearance therebetween, while the fold-up floor member 16 has been swung generally upwardly so that it lies substantially along side of and against the end panel member 12.

A rib member 21 runs along the bottom of the case 11 generally longitudinally of end member 13, which rib member 21 includes a ledge 22 that provides a secure stop for the floor member 16 when the case 11 is in its fully opened position, rib member 21 further including a ridge 23 for nesting engagement with a top edge 24 of another foldable packaging case. In order to provide a secure stacking engagement between a plurality of such cases 11, another rib member 25 having a ridge 26 is structured to stackingly engage an opposite upper edge 27 of said another foldable packaging case.

Figure 3:
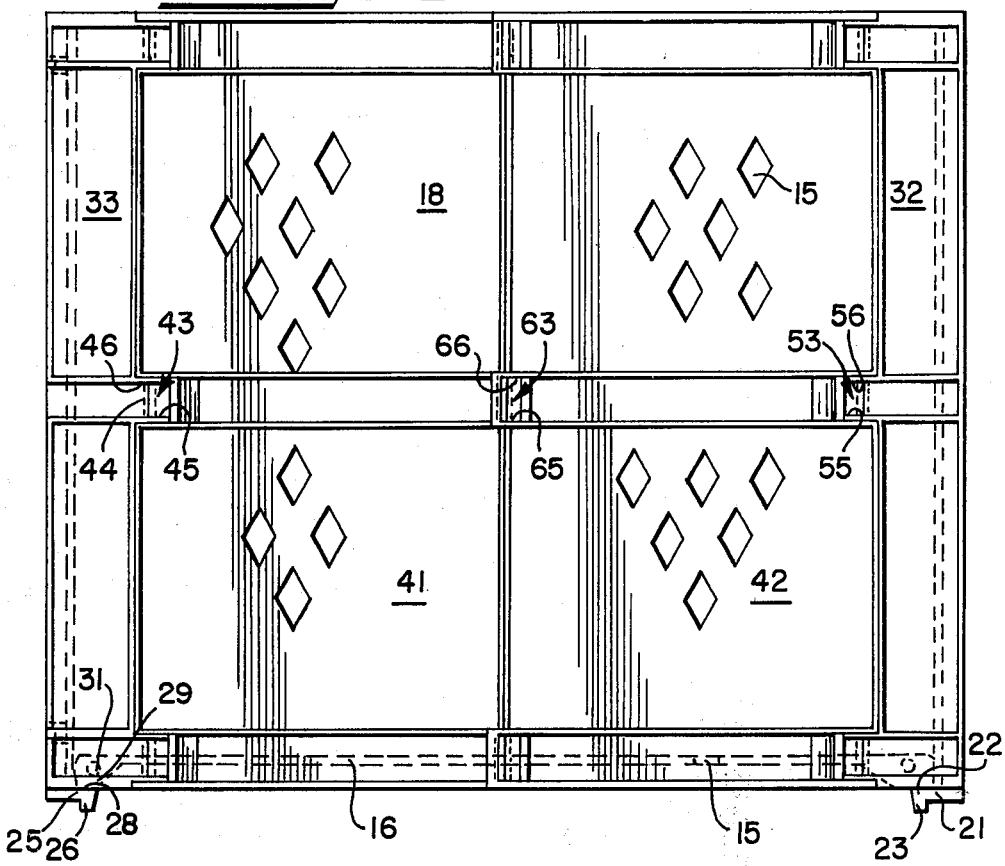
FIG. 3 is an elevational foldable side view of the case of FIG. 1, the foldable side being shown when it is fully opened.

As can be best seen in FIG. 3, the other rib member 25 also has a ledge 28 which provides a stop surface for an end portion 29 of the floor member 16, which end portion 29 lies along the pivoting axis of the floor member 16 and includes one member of a pivotable connector means 31. Typically, pivotable connector means 31 will take the form of a generally short molded pin protruding from each remote edge of the end portion 29 for snap-together operative engagement with a relatively shallow cylindrical indentation within each of a rigid corner portion 32 and another rigid corner portion 33 of each of the end panel members 12 and 13, respectively. Alternatively, the pivotable connector means 31 consists of a pin protruding from each of the corner portions 32 and 33 together with a cylindrical indent in each remote edge of the end portion 29. The pivotable connector means 31 permits movement of the floor member 16 only when the case is in its fully opened condition, between its in-use location as the bottom panel of the unfolded case and its storage location when it lies generally along side of and substantially flush with respect to end member 12.

Figure 4:
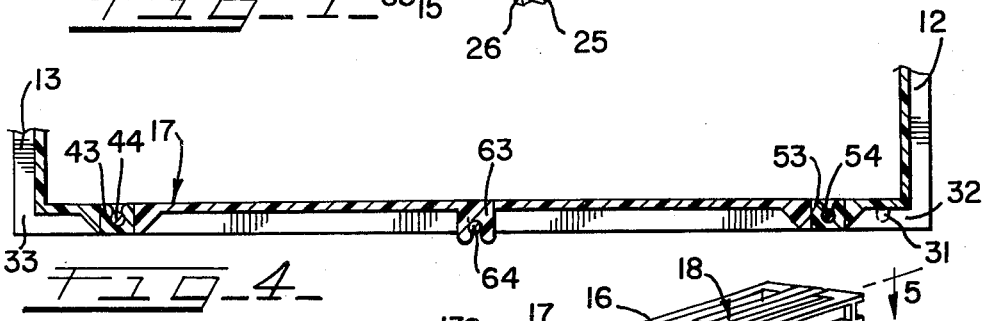
FIG. 4 is a sectional view along line 4—4 of FIG. 1, illustrating the snap-together hinge assembly of the foldable sides.
Figure 5:
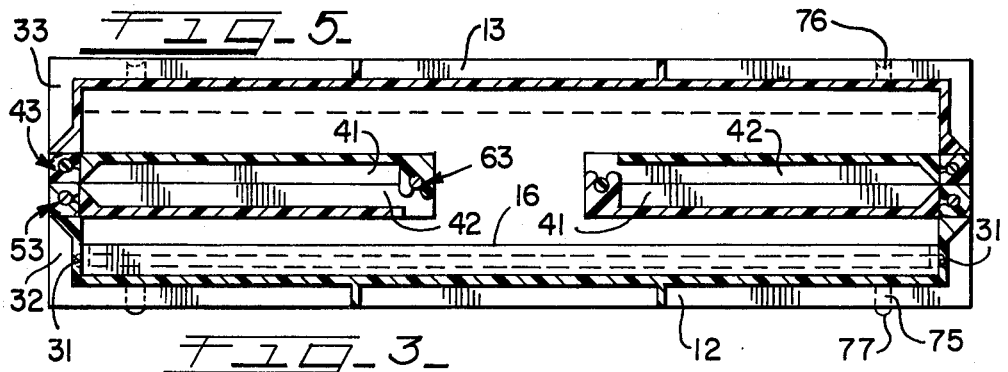
FIG. 5 is a sectional view along the line 5—5 of FIG. 2 illustrating the snap-together hinge assembly means when the case is fully folded or collapsed.
Figure 6:
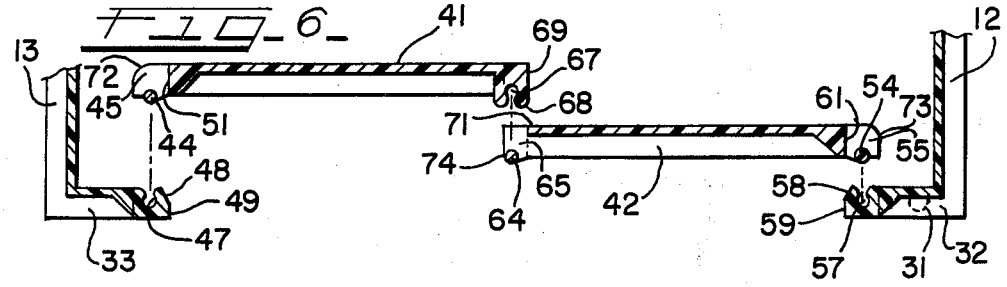
FIG. 6 is an exploded sectional view similar to FIG. 4 and further depicting the snap-together arrangement of the foldable sides.

With particular reference to the foldable side members 17 and 18, each includes a first panel 41 and second panel 42, shown in cross-sectional detail in FIGS. 4, 5 and 6. First panels 41 operatively interengage with the corner portion 33 of end panel member 13 at one or more first snap-together hinge means 43, generally designated as 43, three of them being shown in FIGS. 1, 2 and 3. Each hinge means 43 includes a pivot pin 44 transversely extending from a flat 45 that is transverse to the longitudinal extent of the first panel 41. Pivot pin 44 can have a free end or, for added strength, can be connected to an opposing flat 46 (FIG. 3). Each snap-together hinge means 43 further includes a narrow saddle 47, structured for snap-together, mating and pivotal engagement with the pivot pin 44, preferably having an inner surface that is generally C-shaped in cross-section and two pivot pin grasping fingers, the narrow saddle 47 further including an outer surface that preferably has a bevel 48 for providing clearance between the saddle 47 and the first panel 41 when the first panel is pivoted between its folded condition and its open or in-line condition.

Narrow saddle 47 further includes a remote-end longitudinally extending stop surface 49 on the remote end of the corner portion 33, shown in FIG. 6 adjacent to the bevel 48, and each first panel 41 includes longitudinally extending stop edge 51 defining the flats 45, 46. Each stop surface 49 and each stop edge 51 cooperate with each other to form a first rotation limiting means for preventing outward bulging of the foldable side member 17 when the case 11 is in its unfolded, in-use condition.

Operatively and pivotally interconnecting the second panel 42 and the corner portion 32 of the end panel member 12 are one or more second snap-together hinge means, generally designated as 53, having a structure substantially the same as the first snap-together hinge means 43, such structure including a pivot pin 54, an end flat 55, an optional opposing end flat 56, a narrow saddle 57, a preferred bevel 58, a stop surface 59 on the remote end of the corner portion 32, and a stop edge 61 on the second panel 42. Stop surface 59 and stop edge 61 cooperate with each other to provide a second rotation limiting means.

Foldable side member 17 also has one or more intermediate or third snap-together hinge means, generally designated as 63. Each hinge means 63 is structured along the lines of the hinge means 43 and 53, including a pivot pin 64, an intermediate flat 65, an optional opposing intermediate flat 66, a narrow saddle 67, a preferred round or bevel 68, a longitudinally extending stop surface 69 on the first panel 41 and a longitudinally extending stop edge 71 on the second panel 42. Stop surface 69 and stop edge 71 cooperate with each other to provide a third rotation limiting means to join with the first and the second rotation limiting means and the side edges of the fold-up floor member 16, whereby the first panel 41 and second panel 42 are, when the case 11 is in its unfolded, in-use condition, in line with each other to the extent that foldable side members 17 and 18 provide substantially the same rigidity and structural integrity as do the unitary end panel members 12 and 13.

As can perhaps be best seen in FIG. 4, in the preferred structure illustrated, when the foldable packaging case 11 is in its fully opened state, the various pairs of stop surfaces 49, 59, 69 and stop edges 51, 61, 71 of the respective rotation limiting means are in general engagement with each other, each respective stop surface 49 intended for butting engagement with each respective stop edge 51, each respective stop surface 59 being intended for butting engagement with each respective stop edge 61, and each respective stop surface 69 being intended for butting engagement with each respective stop edge 71 to the extent that outward movement of each first panel 41 and second panel 42 is restricted so that each remains generally with substantially the same plane when the case is open.

It is preferred that each flat 45, 46, 55, 56, 65 and 66 have a broken or rounded face edge or corner 72, 73, 74 to provide rotational clearance between the first panel 41 and the corner portion 33, between the second panel 42 and corner portion 32, and between the first panel 41 and the second panel 42. This broken or rounded free edge or corner 72, 73, 74 can when necessary, depending upon the structure of the corner portions 32 and 33, extend for substantially the entire length of each first panel 41 and second panel 42.

FIG. 5 depicts the on-end attitude of each case 11 for stacking one folded case upon the other, the stacking being facilitated by stacking means 75, each of which includes an indent 76 and a protrusion member 77 which may be of any desired shape so long as protrusion member 77 fits securely within indent 75 to enable each folded case 11 to lie generally flush on and in abutting engagement with another folded case 11 to form an interlocking and stable stack of folded cases.

The case 11 is molded of a relatively rigid and durable material, such as an injection or compression molded synthetic resin, that will now be adversely affected, for example readily crack or melt, at refrigeration temperatures or at commercial washing temperatures. Especially suitable in this regard are polypropylene resins.

In use, case 11 permits transport and storage of relatively small, difficult to bulk handle, and somewhat fragile products such as cartons of dairy products or other fluids, a plurality of such products being handled as a unit within a case in its opened state. Typically, a delivery truck fully loaded with product-containing cases leaves a manufacturing or processing facility to make a number of stops at retail outlets, each stop being to deliver a small portion of the full truck load and hopefully also being for picking up empty cases. If non-foldable cases are used, as is generally the situation in today's dairy processing industry, a delivery driver is reluctant to collect the empty cases unless a substantial portion of the full cases had been already delivered to previous retail outlets so that the truck has an abundance of free space needed to avoid inefficient and annoying multiple shifting of full and empty cases to allow for delivery of full cases at a subsequent retail outlet. Because the volume taken up by case 11 in its folded condition is significantly less than that of its open condition, and because the cases 11 are able to be readily and securely stacked onto each other by stacking means 75, any need to shift the stacked cases is significantly reduced; and when shifting must be done, this is facilitated by the secure stackability of the folded cases 11.

After the delivery truck returns to the manufacturing or processing facility, the folded cartons are removed from the truck and stored in a relatively small storage location in their folded condition. They are transported to the end of the processing line, still folded and stacked as they were at the retail outlet. The processing line can be provided with a simple, automatic case unfolding means suitable for cases 11 due to their structural details, such an unfolding means including a means to securely hold one of the end wall panel members 12, 13 while a mechanical arm hooks onto the other end wall panel member 12, 13 and pulls it or otherwise operates to spread apart the two end wall panel members 12, 13 until the folded side members 17, 18 are substantially in-line and the floor member 16 drops down and rests upon the ledge 22 of the rib member 21 to fully open the case for filling with individual products coming off the processing lines.

It will be apparent to those skilled in this art that the present invention can be embodied in various forms; accordingly, this invention is to be construed and limited only by the scope of the appended claims.

We claim:

1. In a foldable packaging case having two foldable side wall members including first and second panels that fold inwardly generally onto each other, two end wall panel members between said foldable side wall members, panel hinge means between said first panel, said second panel and said two end wall panel members for enabling the first and second panels to fold inwardly, a fold-up floor member sized to fit between said two foldable side wall members and said two end wall panel members, means for hingedly mounting said floor member to one of said end wall panel members, the improvement comprising said panel hinge means being a snap-together, snap-apart hinge means molded of a synthetic resin with and onto said first panel, said second panel and said two end wall panel members, wherein a plurality of said snap-together, snap-apart hinge means are provided, including first snap-together, snap-apart hinge means pivotally interconnecting said first panel to a corner portion of one of said two end wall panel members, second-snap together, snap-apart hinge means pivotally interconnecting said second panel to a corner portion of another of said two end wall panel members, each said first panel and second panel corner portions having a generally L-shaped cross-section including a leg protruding generally transversely from one of said end wall panel members, third snap-together, snap-apart hinge means pivotally interconnecting said first panel to said second panel, each of said snap-together, snap-apart hinge means including a pivot pin and a narrow saddle structured for snapping, releasably mating, pivotable interengagement with said pivot pin, said snap-together, snap-apart hinge means further including rotation limiting means which includes a longitudinally extending stop surface on said saddle at its remote end, a longitudinally extending stop edge on each of said first and second panels, said first and second snap-together, snap-apart hinge means being at the remote end of each of said respective legs of the panel corner portions, said longitudinally extending stop surface on said respective saddles of the first and second hinge means being at the extreme remote end of each respective leg, said longitudinally extending stop edge on each of said first and second panels being a surface that is generally parallel to the longitudinal extent of each of said first and second panels, a flat on each of said first and second panels, each said flat being generally transverse to the longitudinal extent of said first and second panels and extending beyond the respective stop edges, and said respective pivot pins extend from said respective flats.

2. The foldable packaging case of claim 1, wherein there are provided a plurality of said first, second and third snap-together, snap-apart hinge means.

3. The foldable packaging case of claim 1, wherein said third snap-together, snap-apart hinge means includes a flat transverse to the longitudinal extent of said second panel, said pivot pin thereof transversely extends from said flat, a stop surface is at an edge of said first panel, and the narrow saddle of the third hinge means is adjacent to and integral with said edge stop surface.

4. The foldable packaging case of claim 1, wherein said flats on said first and second panels have a broken free corner to provide rotational clearance between said first panel and one of said end wall panel members and between said second panel and the other of said end wall panel members.

5. The foldable packaging case of claim 1, wherein said narrow saddle has an outer surface having a bevel to provide clearance between said saddle and one of said first and second panels.

6. The foldable packaging case of claim 1, wherein said pivot pin is cylindrical and said narrow saddle has an inner surface that is C-shaped in cross section and has two pivot pin grasping fingers.

7. The foldable packaging case of claim 1, wherein said stop surface and said stop edge are in butting engagement when said first and second panels of the foldable side wall members are generally in-line with one another and the packaging case is in its opened condition.

8. The foldable packaging case of claim 1, wherein said means for hingedly mounting the floor member includes a molded pin and a cylindrical indent.

9. The foldable packaging case of claim 1, wherein another of said end wall panel members includes a rib member having an internal ledge at a height approximately the same as that of said means for hingedly mounting the floor member, said ledge of the rib member being a stop for said floor member when the packaging case is in its opened condition.

10. The foldable packaging case of claim 1, wherein each of said two end wall panel members has a rib member at the bottom thereof, said rib members being structured to stackingly engage corresponding upper edges of said end wall panel members of another said foldable packaging case when both said cases are in an opened condition.

11. The foldable packaging case of claim 1, wherein one of said end wall panel members includes an indent and another of said end wall panel members includes a complementary protrusion member, said indent and said protrusion member being means for stacking one said case upon another said case when both said cases are in a folded condition.

12. In a foldable packaging case having two foldable side wall members including first and second panels that fold inwardly generally onto each other, two end wall panel members between said foldable side wall members, panel hinge means between said first panel, said second panel and said two end wall panel members for enabling the first and second panels to fold inwardly, a fold-up floor member sized to fit between said two foldable side wall members and said two end wall panel members, means for hingedly mounting said floor member to one of said end wall panel members, the improvement comprising said panel hinge means being a plurality of first, second and third snap-together, snap-apart hinge means;

each of said plurality of first snap-together, snap-apart hinge means including a first narrow saddle member integrally molded with one of said end wall panel members, said first saddle member having a C-shaped inner surface and two fingers projecting therefrom, each of said first snap-together, snap-apart means further including a transversely extending flat on said first panel and a first pivot pin transversely projecting from and integrally molded with said flat, said first pivot pin being in releasable, rotatable interengagement with said C-shaped inner surface of the first saddle member;

each of said plurality of second snap-together, snap-apart hinge means including a second narrow saddle member integrally molded with another of said end wall panel members, said second saddle member having a C-shaped inner surface and two fingers projecting therefrom, each said second snap-together, snap-apart means further including a transversely extending end flat on said second panel and a second pivot pin transversely projecting from and integrally molded with said flat, said second pivot pin being in releasable, rotatable interengagement with said C-shaped inner surface of the second saddle member;

each of said plurality of third snap-together, snap-apart hinge means including a third narrow saddle member integrally molded with said first panel, said third saddle member having a C-shaped inner surface and two fingers projecting therefrom, each said third snap-together means further including a transversely extending intermediate flat on said second panel and a third pivot pin transversely projecting from and integrally molded with said flat, said third pivot pin being in rotatable interengagement with said C-shaped inner surface of the third saddle member;

each of said first, second and third snap-together, snap-apart hinge means includes rotation limiting means having a stop surface and a stop edge in general butting relationship when the packaging case is in its open condition, said butting relationships placing said foldable side wall members in secure straight-line, end-to-end relationship with each other and secure generally perpendicular relationship to said two end wall panel members, said secure straight-line, end-to-end relationship and said secure generally perpendicular relationship being secure with respect to prevention of outward movement of said foldable side wall members; and the other of said end wall panel members includes a rib member having an internal ledge that is a stop for said fold-up floor member when the packaging case is in its opened condition to prevent inward movement of said foldable side wall members.

13. The case of claim 12, wherein the rotation limiting means of said first hinge means includes a first stop surface on the remote end of said first saddle member that is generally adjacent one of said fingers thereon and a first stop edge defining said flat on the first panel, said first stop surface and first stop edge being in said general butting engagement when the packaging case is in its open condition; the rotation limiting means of said second hinge means includes a second stop surface on the remote end of said second saddle member that is generally adjacent one of said fingers thereon and a second stop edge defining said end flat on the second panel, said second stop surface and second stop edge being in said general butting engagement when the packaging case is in its open condition; and the rotation limiting means of said third hinge means includes a third surface on the remote end of said third saddle member that is generally adjacent one of said fingers thereon and a third stop edge partially defining said intermediate flat on the second panel, said third stop surface and third stop edge being in said general butting engagement when the packaging case is in its open condition.

* * * * *

UNITED STATES PATENT AND TRADEMARK OFFICE

CERTIFICATE OF CORRECTION

PATENT NO. : 4,235,345

DATED : November 25, 1980

INVENTOR(S) : VandeDrink et al

It is certified that error appears in the above–identified patent and that said Letters Patent are hereby corrected as shown below:

Column 5, line 2, "face" should be --free--.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*